United States Patent [19]

Florin

[11] 4,282,412

[45] Aug. 4, 1981

[54] MERCURY SWITCH FOR MONITORING POSITION OF PATIENT

[76] Inventor: Robert E. Florin, 7921 S. Painter Ave., Whittier, Calif. 90602

[21] Appl. No.: 133,002

[22] Filed: Mar. 24, 1980

Related U.S. Application Data

[63] Continuation-in-part of Ser. No. 935,363, Aug. 21, 1978, abandoned.

[51] Int. Cl.[3] ..... H01H 29/20

[52] U.S. Cl. ..... 200/52 R; 200/61.52; 200/220

[58] Field of Search ..... 200/DIG. 2, 61.47, 61.52, 200/183, 220, 221, 228, 229, 236, 52; 340/568, 573

[56] References Cited

U.S. PATENT DOCUMENTS

| | | | |
|---|---|---|---|
| 1,658,207 | 2/1928 | Ogden | 200/61.47 |
| 2,115,948 | 5/1938 | Erich | 200/61.47 |
| 2,232,626 | 2/1941 | Olso | 200/229 |
| 2,417,993 | 3/1947 | Porter | 200/61.47 |
| 2,823,367 | 2/1958 | Huron . | |
| 2,863,014 | 12/1958 | Deer et al. . | |
| 3,035,132 | 5/1962 | Güirke et al. | 200/61.47 |
| 3,041,594 | 6/1962 | Charles . | |
| 3,208,062 | 9/1965 | Gregory | 200/61.52 X |
| 3,325,799 | 6/1967 | Farris . | |
| 3,586,798 | 6/1971 | Holmes | 200/DIG. 2 |
| 3,614,763 | 10/1971 | Yannuzzi | 340/573 |
| 3,634,885 | 1/1972 | Barkley | 340/573 |
| 3,743,802 | 7/1973 | Avenick | 200/61.47 |
| 3,787,647 | 1/1974 | Hughes | 200/61.47 |
| 3,885,576 | 5/1975 | Symmer | 340/573 |
| 3,955,356 | 5/1976 | Le Cocq | 200/61.52 X |
| 3,983,350 | 9/1976 | Camin | 200/61.47 |

FOREIGN PATENT DOCUMENTS

| | | | |
|---|---|---|---|
| 277848 | 12/1951 | Switzerland | 340/573 |

*Primary Examiner*—James R. Scott
*Attorney, Agent, or Firm*—Lyon & Lyon

[57] ABSTRACT

A mercury switch assembly adapted to be secured to an anterior horizontal surface of a patient and connected to an electrical alarm system. The assembly includes a pair of connected and enclosed chambers which contain a quantity of mercury which moves into contact with electric terminals that project into one of the chambers only when the switch assembly is displaced from horizontal by a predetermined degree of inclination. The assembly contains an elliptical shaped head chamber with lateral extensions connected to a deep rounded foot chamber by a narrow throat passageway. The mercury normally lies within the head chamber in the horizontal position, but establishes electrical connection between the terminals contained in the foot chamber when the tilt threshold of the assembly is reached. The foot chamber retains the mercury in contact with the terminals despite subsequent displacements of the assembly until the device is removed and inverted, thereby causing the mercury to return to the head chamber.

7 Claims, 11 Drawing Figures

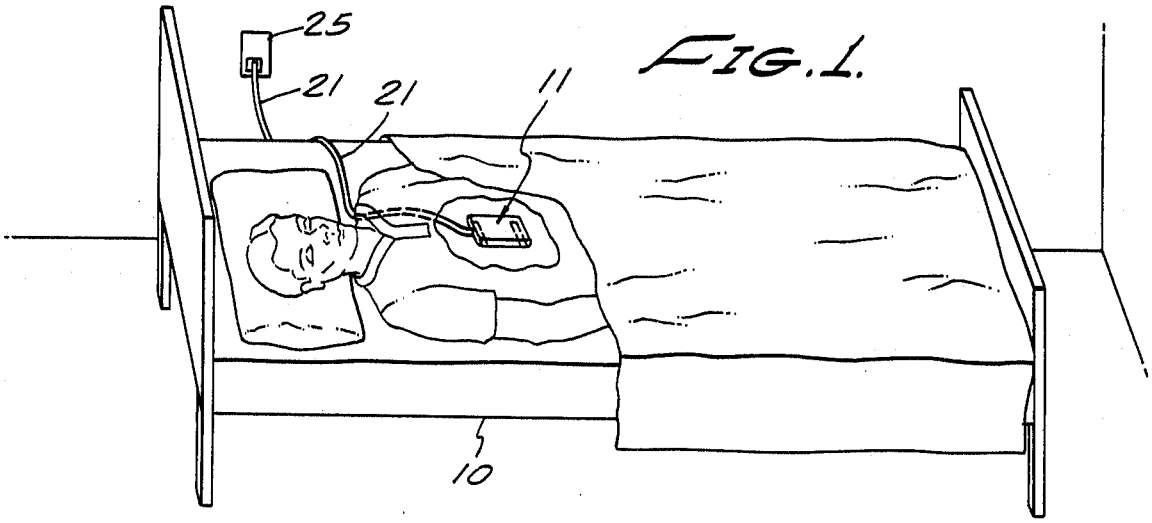
FIG. 1.
FIG. 2.
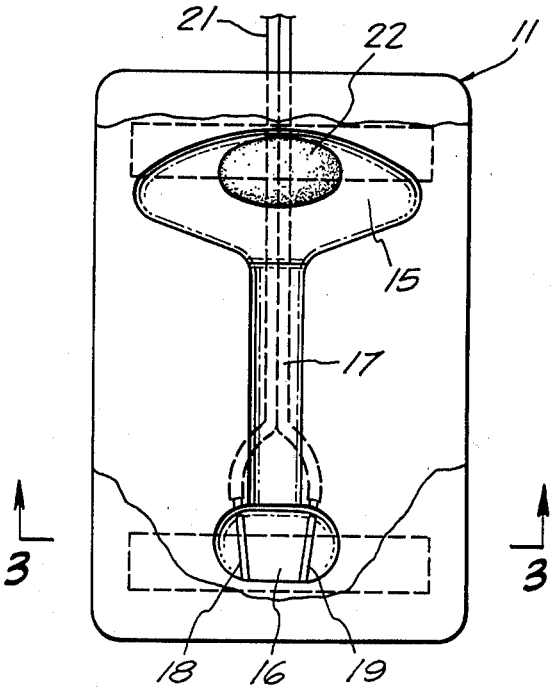
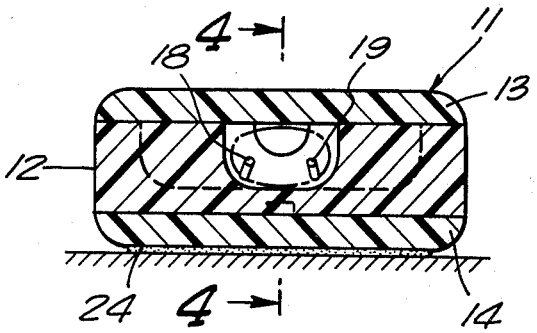
FIG. 3.
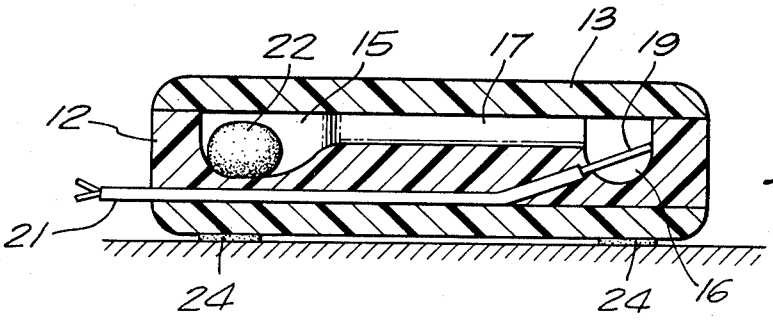
FIG. 4.

MERCURY SWITCH FOR MONITORING POSITION OF PATIENT

This application is a Continuation-in-Part of Applicant's pending application Ser. No. 935,363 filed Aug. 21, 1978, now abandoned.

This invention relates to an alarm switch having utility in the field of medicine and nursing which affords a reliable means of monitoring certain specific deviations of a monitored surface of a patient's body with respect to the horizontal or supine position. The particular utility of such a position-sensitive alarm switch lies in its ability to forewarn attendant personnel of certain movements of a monitored patient that may precede a fall.

In the past, various restraining or confining devices such as fabric jackets attached to the bed, side rails, and limb restraints have been employed with varying success. Rather frequently, confused or sedated patients manage to escape such restraints, and they frequently fall when attempting to get out of bed or after leaving the bed while walking about the room. The incidence of significant injury from such accidents is substantial, and, despite special efforts by personnel attending such patients, injuries continue to occur.

Known devices the prior systems have not been designed to selectively signal the specific changes in patient position encompassed by the present invention without causing frequent false alarms. Also, the prior art relating to the use of position-sensitive switch devices to operate an alarm system have not been readily adaptable to monitoring of patients seated in chairs or wheel chairs as well as bed patients.

An important objective of the present invention is to provide an alarm device that is selective in operation and is capable in detecting certain specific movements of a patient's body that occur reliably before fall from bed or a chair, i.e., a change from an approximate horizontal position of the anterior surface of the patient's chest or thigh to a more vertical position of either of these surfaces which may be monitored. It has been determined that switch operation at approximately 60° of elevation of the monitored surface provides reliable warning of the change in position of the patient that may precede a fall without generating unnecessary false alarms associated with random changes or adjustments of the patient's resting position. Activation of an alarm system when the patient does exceed the switch threshold alerts the personnel attending the patient to the possibility of impending injury and may prevent such an occurrence.

Another object of the invention is to provide an alarm system capable of detecting certain changes of position of the monitored patient which will continue to operate even if the patient changes position from that which activated the alarm, and will continue until deactivated by the nursing staff. This also has value in cases where absolute bed rest is required, and alerts the nursing staff to such patients who may be more active than desirable.

Another object of the invention is to provide an alarm system which will integrate with existing hospital call systems and activate an individual patient's call light and/or buzzer, thereby notifying the nurse of the exact location of the patient at risk from excessive activity. A system capable of identifying each patient so monitored permits simultaneous monitoring of a number of patients in a nursing ward or special care unit, indicating abnormal activity in one or more of those patients simultaneously. When integrated in such a fashion, the invention requires no additional power or electrical devices. In situations where no existing call or alarm system is available, a separately powered alarm system may be connected to provide audible or visual notice of excessive motion by the patient.

Other related objects of this invention are the provision of a simple switching device and the associated electrical circuitry which is fully automatic in operation after application to the patient, and is dustproof, waterproof, and requires no adjustment or service after proper application.

A preferred embodiment of the invention includes a rectangular enclosure of non-conductive material with parallel surfaces, containing a cavity resembling a longitudinal half section of a bar-bell, flat on the upper surface and convex on the inferior aspect. The cavity is sealed within the non-conductive material and contains a small amount of mercury. The longitudinal axis of the cavity is aligned with both the long axis of the enclosure and the long or spinal axis of the patient. Two chambers of unequal size are connected at each end of a middle axial portion of the cavity which is narrow and acts as a passageway for the mercury. The larger head chamber is rounded or elliptical in outline, extends laterally in both directions, and is deeper than the throat passageway. This configuration allows for rotary movements around the long axis of the assembly without inappropriate activation of the switch device and generation of false alarms. The junction between the head chamber and the throat passageway is smooth and tapered and acts to restrain the movement of the contained mercury droplet in the head chamber from entering the throat passageway until a predetermined degree of inclination of the long axis of the assembly is reached. The throat passageway is uniform in its cross section, approximately semi-circular and connected to the smaller foot chamber which is roughly globular and is of a size designed to be substantially filled by the mercury droplet and the contained electrodes when the switch assembly is in the operative or alarm position. The junction between the floor of the throat passageway and the foot chamber is sharp and angular, approximating 90°. This provides a dropoff into the relatively deep well-like reservoir in the foot chamber which acts to retain the mercury droplet even during subsequent random displacements of the device after activation, which assures continuous operation of the alarm system connected to the contained electrodes once the switch has been actuated.

Other and more detailed objects and advantages will appear hereinafter.

In the drawings:

FIG. 1 is a perspective view partly broken away, showing a preferred embodiment of this invention as applied to a bed patient.

FIG. 2 is a front view partly broken away, showing details of the switch assembly.

FIG. 3 is a transverse sectional view taken substantially on the lines 3—3 as shown in FIG. 2.

FIG. 4 is a sectional elevation taken substantially on the lines 4—4 as shown in FIG. 3.

Figure 5:
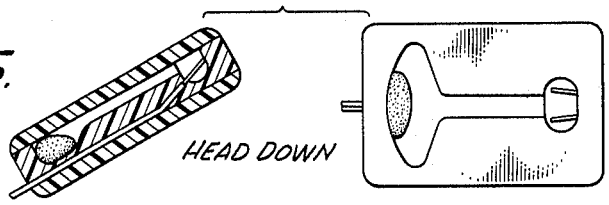
FIGS. 5-11 are paired front view and sectional elevations taken substantially on the lines 4—4 shown in FIG. 3, showing the effect of various inclinations on the contained mercury.
Figure 6:
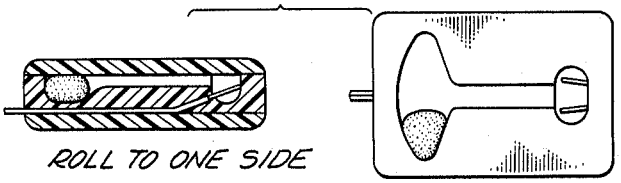
Figure 7:
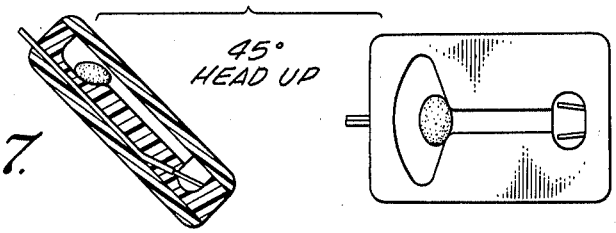
Figure 8:
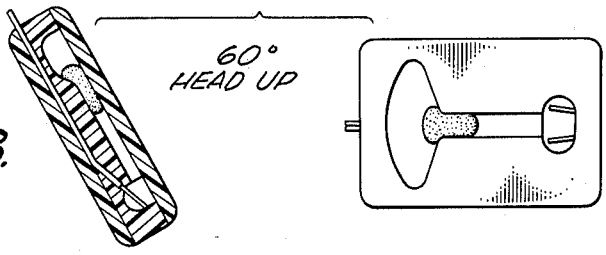
Figure 9:
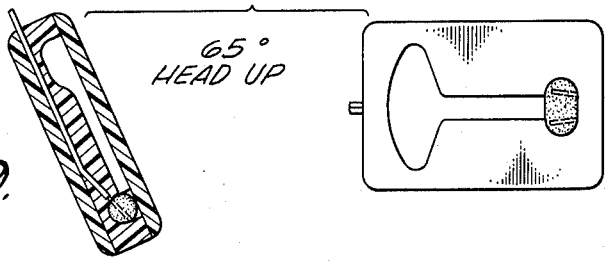

Referring to the drawings, the bed is a standard hospital bed of the type used in hospitals, convalescent homes, etc. The bed 10 would normally be provided with retractable railings or fences, but these are omitted for clarity of illustration.

The switch assembly generally designated 11 has a rectangular body 12 closed by a cover plate 13 and a bottom plate 14. The body 12 and plates 13 and 14 may be formed of electrically non-conducting plastic material fixed together by conventional sealants. Defined between the body 12 and the cover plate 13 are a head chamber 15 and a foot chamber 16 connected by a narrow passageway 17. Two metallic electrodes or terminals 18 and 19 extending from the two-wire cable 21 are spaced apart within the foot chamber 16. An electrically conducting liquid such as a droplet or globule of mercury 22 normally rests in the relatively wide head chamber 15, but when the switch assembly 11 is moved from horizontal position toward a vertical position beyond approximately 60°, the mercury 22 moves down the passageway 17 and into the foot chamber 16 to establish an electrical connection between the terminals 18 and 19. The head chamber 15 and the foot chamber 16 are each deeper than the narrow passageway 17. The cover plate 13 is flat on its underside and forms the roof of the head chamber 15, narrow passageway 17 and foot chamber 16. The surface 26 connecting the head chamber 15 to the narrow passageway 17 is smooth and rounded while the surface 27 connecting the narrow passageway 17 to the foot chamber 16 is sharp and abrupt.

In an embodiment reduced to practice, the size of the enclosure 11 was 2 cm. wide by 3 cm. long and 8 mm. thick. The head chamber 15 was 12 to 15 mm. wide, 5 mm. high, and 3 to 3.5 mm. deep. The narrow passageway 17 was 2.5 to 3 mm. deep and wide since it was semicircular in shape, and 4 to 5 mm. long. The foot chamber 16 was 5 to 7 mm. wide and 3.5 to 4 mm. deep. The mercury droplet 22 was approximately 2.5 mm. in diameter weighing approximately 0.25 grams. In FIGS. 4–11, the operational features of the switch device are illustrated for a series of varying angular positions of the assembly.

Figure 10:
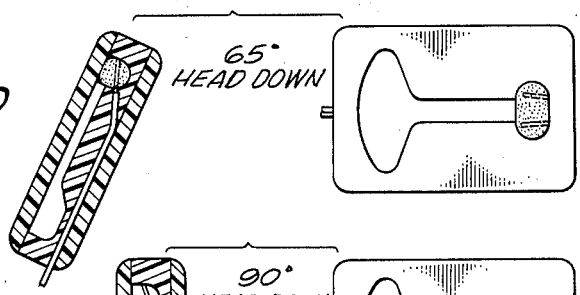
Figure 11:
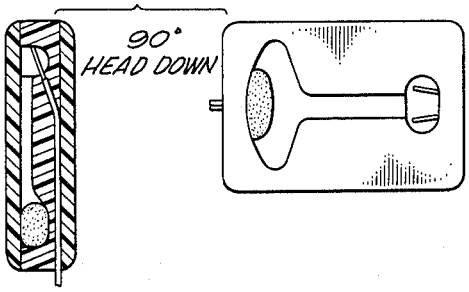

In FIG. 4, the assembly is oriented in a horizontal position without lateral rotation about the long axis such as when applied to a patient's chest or thigh for monitoring, and the mercury droplet 22 lies at the head chamber 15. Due to the particular design of the head chamber 15 with its lateral extensions and deeper floor, the mercury is retained in that chamber during lateral rotations as in FIG. 6, and even during elevation of the head chamber up to approximately 60°, FIGS. 7 and 8. Beyond 60° elevation, the mercury droplet 22 enters the throat passageway 17 and rapidly flows down that passageway into the foot chamber 16 as in FIG. 9, where the mercury submerges the contained electrodes 18 and 19 and establishes electrical connection which in turn activates the external alarm system in a manner not shown in the diagrams. FIG. 10 shows the effect of the particular design of the foot chamber 16 and the well-like effect of sharp junction 27 upon the mercury droplet present in the foot chamber 19, acting to retain the mercury within the foot chamber and in contact with the electrodes 18 and 19 in the manner of a latching relay. Only when the assembly is inverted in a 90° head-down position as in FIG. 11, does the mercury flow back through the throat passageway 17 and re-enter the head chamber 15, thus recharging the switch device for its next operational cycle.

Construction of the switch assembly 11 may be done rather simply by fashioning the several chambers 15 and 16 and the connecting passageway 17 within the upper surface of a block of solid plastic or similar insulating material 12. Small holes are drilled so as to enter the deep portion of the foot chamber 16 and the electrode wires introduced through such holes as to be exposed within the foot chamber 16, as is shown in FIG. 4 with one of the electrodes 19. The several wires comprising the insulated cord 21 which connects the electrodes to the alarm system are brought out beneath the throat passageway and head chamber 15 in order to provide a secure anchor for the cord 21 and to guide the cord in the direction of the upper portion of the patient's body which is common to many current monitoring leads in use, such as standard electrocardiogram monitoring leads. The cord 21 is anchored to the block housing the body of the switch device 12 by a plate of insulative material 24 of the same composition as the main body 12, and sealed with suitable adhesives. The mercury droplet 22 is then placed in one of the chambers, and the entire upper surface closed by application of the top cover 13 which is also sealed by adhesives. The final step is to apply a removable adhesive to the bottom surface of the assembly 24 in order to prepare it for use on a patient.

Tests conducted with a series of working models of dimensions corresponding to those mentioned above have confirmed the operational features illustrated in FIGS. 4–11. In particular, there is a notable absence of false alarms due to random movements or turns by the monitored patient, even during changes of position for nursing care or for meals. However, when the patient does exceed a 60° inclination, either from a supine position or while arising from lying on either side, the switch device was prompt in activating the attached alarm system. Furthermore, once activated, the persistence of electrical contact by the mercury droplet in the foot chamber insures a continuing alarm even if the patient should turn or fall, and requires a prompt response by the attending personnel.

Having fully described my invention, it is to be understood that I am not to be limited to the details herein set forth but that my invention is of the full scope of the appended claims.

I claim:

1. A mercury switch assembly adapted to be secured to a patient for monitoring changes in position, comprising in combination: a body formed of electrically non-conducting material having walls defining a head chamber and a foot chamber longitudinally spaced, the body having a narrow throat passageway connecting said chambers, said chambers being deeper and wider than said throat passageway, spaced electrodes projecting into said foot chamber, a quantity of mercury capable of contacting said electrodes to form an electrical connection between them, said quantity of mercury having a volume less than the volume of the head chamber and being normally contained within said head chamber when the switch assembly is in normal horizontal position, said walls being so shaped that said quantity of mercury moves by gravity from said head chamber through said narrow throat passageway and into said foot chamber only when the switch assembly is tilted to incline said throat passageway to a predetermined degree, said head chamber having lateral extensions of substantial depth for continuously retaining said quantity of mercury in said head chamber during lateral turning movement of the switch assembly when the inclination of said throat passageway is less than said predetermined degree.

2. The combination set forth in claim 1 in which said predetermined degree is substantiallly 60°.

3. A mercury switch assembly adapted to be secured to a patient for monitoring changes in position, comprising in combination: a body formed of electrically non-conducting material having walls defining a head chamber and a foot chamber longitudinally spaced and a narrow throat passageway connecting said chambers, said chambers being deeper and wider than said throat passageway, spaced electrodes projecting into said foot chamber, a quantity of mercury capable of contacting said electrodes to form an electrical connection between them, said quantity of mercury having a volume less than that of the head chamber and approximately the same as the foot chamber, said quantity of mercury being normally contained within said head chamber when the switch assembly is in normal horizontal position, said walls being so shaped that said quantity of mercury moves by gravity from said head chamber through said narrow throat passageway and into said foot chamber only when the switch assembly is tilted to incline said throat passageway to a predetermined degree, said head chamber having lateral extensions of substantial depth for continuously retaining said quantity of mercury in said head chamber during lateral turning movement of the switch assembly when the inclination of said throat passageway is less than said predetermined degree.

4. The combination set forth in claim 3 in which said predetermined degree is substantially 60°.

5. A mercury switch assembly adapted to be secured to a patient for monitoring changes in position, comprising in combination: a body formed of electrically non-conducting material having walls defining a head chamber and a foot chamber longitudinally spaced and a narrow throat passageway connecting said chambers, said chambers being deeper and wider than said throat passageway, spaced electrodes projecting into said foot chamber, a quantity of mercury capable of contacting said electrodes to form an electrical connection between them, said quantity of mercury having a volume less than that of the head chamber and approximately the same as the foot chamber, said quantity of mercury being normally contained within said head chamber when the switch assembly is in normal horizontal position, said walls being so shaped that said quantity of mercury moves by gravity from said head chamber through said narrow throat passageway and into said foot chamber only when the switch assembly is tilted to incline said throat passageway to a predetermined degree, said throat passageway having a smooth rounded intersection with said head chamber and having an abrupt shoulder intersection said foot chamber, said abrupt shoulder preventing return of said quantity of mercury to said head chamber until the switch assembly is moved to bring the inclination of said throat passageway to substantially a vertical position.

6. A mercury switch assembly adapted to be secured to a patient for monitoring changes in position, comprising in combination: a body formed of electrically non-conducting material having walls defining a head chamber and a foot chamber longitudinally spaced, the body having a narrow throat passageway connecting said chambers, said chambers being deeper and wider than said throat passageway, spaced electrodes projecting into said foot chamber, a quantity of mercury capable of contacting said electrodes to form an electrical connection between them, said quantity of mercury having a volume less than that of the head chamber and approximately the same as the foot chamber, said quantity of mercury being normally contained within said head chamber when the switch assembly is in normal horizontal position, said walls being so shaped that said quantity of mercury moves by gravity from said head chamber through said narrow throat passageway and into said foot chamber only when the switch assembly is tilted to incline said throat passageway to a predetermined degree, said head chamber having lateral extensions of substantial depth for continuously retaining said quantity of mercury in said head chamber during lateral turning movement of the switch assembly when the inclination of said throat passageway is less than said predetermined degree, said throat passageway having a smooth rounded intersection with said head chamber and having an abrupt shoulder intersecting said foot chamber, said abrupt shoulder preventing return of said quantity of mercury to said head chamber until the switch assembly is moved to bring the inclination of said throat passageway to substantially a vertical position.

7. A mercury switch assembly for monitoring changes in position of a patient, comprising in combination: a body formed of electrically non-conducting material adapted to be secured to the chest or thigh of the patient, said body having walls defining a head chamber and a foot chamber longitudinally spaced, the body having a narrow throat passageway connecting said chambers, said chambers being deeper and wider than said throat passageway, spaced electrodes projecting into said foot chamber, a ball of mercury capable of contacting said electrodes to form an electrical connection between them, said mercury ball having a volume less than that of the head chamber and approximately the same as the foot chamber, said mercury ball being normally contained within said head chamber when the switch assembly is in a normal horizontal position, said walls being so shaped that said mercury ball moves by gravity from said head chamber through said narrow throat passageway and into said foot chamber only when the switch assembly is tilted to incline said throat passageway to a predetermined degree, said head chamber having lateral extensions of substantial depth for continuously retaining said mercury ball in said head chamber during lateral turning movement of the switch assembly when the inclination of said throat passageway is less than said predetermined degree, and selectively operable means on said body for preventing return of said mercury ball to said head chamber, but adapted to selectively permit said mercury ball to be returned to said head chamber.

* * * * *